US008237365B2

(12) United States Patent
Arndt et al.

(10) Patent No.: US 8,237,365 B2
(45) Date of Patent: Aug. 7, 2012

(54) ENCLOSED HIGH PRESSURE DISCHARGE LAMP

(75) Inventors: Joachim Arndt, Brieselang (DE); Uwe Fidler, Berlin (DE); Ralph Hauschild, Beelitz (DE)

(73) Assignee: Osram AG, Munich (DE)

( * ) Notice: Subject to any disclaimer, the term of this patent is extended or adjusted under 35 U.S.C. 154(b) by 0 days.

(21) Appl. No.: 12/954,706

(22) Filed: Nov. 26, 2010

(65) Prior Publication Data

US 2011/0148295 A1 Jun. 23, 2011

(30) Foreign Application Priority Data

Dec. 22, 2009 (DE) ..... 10 2009 055 137

(51) Int. Cl.
*H01J 17/16* (2006.01)
*H01J 11/00* (2006.01)
*H01J 5/00* (2006.01)

(52) U.S. Cl. ..... 313/634; 313/567; 313/636; 313/317

(58) Field of Classification Search ..... None
See application file for complete search history.

(56) References Cited

U.S. PATENT DOCUMENTS

| | | | | |
|---|---|---|---|---|
| 3,808,495 | A | 4/1974 | Win | |
| 5,243,251 | A | 9/1993 | Inukai et al. | |
| 6,692,432 | B1 * | 2/2004 | Yarush et al. | 600/179 |
| 7,439,662 | B2 | 10/2008 | Arndt et al. | |
| 2001/0011872 | A1 | 8/2001 | Matsumoto et al. | |
| 2008/0048541 | A1 * | 2/2008 | Sumrall et al. | 313/112 |
| 2008/0208297 | A1 * | 8/2008 | Gertner et al. | 607/92 |
| 2009/0267480 | A1 * | 10/2009 | Kawakatsu et al. | 313/312 |

FOREIGN PATENT DOCUMENTS

| | | | |
|---|---|---|---|
| EP | 0273442 | A2 | 7/1988 |
| EP | 1652212 | A0 | 2/2005 |
| EP | 2112684 | A2 | 10/2009 |
| WO | 2008022929 | A1 | 2/2008 |

OTHER PUBLICATIONS

English language abstract for WO 2008/022929 A1.

* cited by examiner

*Primary Examiner* — Natalie Walford

(57) ABSTRACT

In various embodiments, a high-pressure discharge lamp is provided. The high-pressure discharge lamp may include a discharge vessel which is accommodated in a tubular outer bulb, wherein a major part of the outer bulb is closely surrounded by a transparent sleeve composed of highly heat-resistant plastic.

10 Claims, 4 Drawing Sheets

ENCLOSED HIGH PRESSURE DISCHARGE LAMP

CROSS-REFERENCE TO RELATED APPLICATION

This application claims priority to German Patent Application Serial No. 10 2009 055 137.9, which was filed Dec. 22, 2009, and is incorporated herein by reference in its entirety.

TECHNICAL FIELD

Various embodiments are based on a high-pressure discharge lamp. Lamps such as these are, for example, high-pressure discharge lamps for general illumination or for photo-optical purposes.

BACKGROUND

EP 1 652 212 discloses a high-pressure discharge lamp having a ceramic discharge vessel, which has fragment protection by being surrounded by two sleeves.

WO 2008/022929 discloses a discharge lamp which is sheathed by a plastic sleeve, in particular for fragment protection purposes.

The use of such plastic sleeves is, however, restricted to lamps with a low operating temperature since, otherwise, no suitable plastic is available.

SUMMARY

In various embodiments, a high-pressure discharge lamp is provided. The high-pressure discharge lamp may include a discharge vessel which is accommodated in a tubular outer bulb, wherein a major part of the outer bulb is closely surrounded by a transparent sleeve composed of highly heat-resistant plastic.

BRIEF DESCRIPTION OF THE DRAWINGS

In the drawings, like reference characters generally refer to the same parts throughout the different views. The drawings are not necessarily to scale, emphasis instead generally being placed upon illustrating the principles of various embodiments. In the following description, various embodiments are described with reference to the following drawings, in which.

DESCRIPTION

Figure 1:
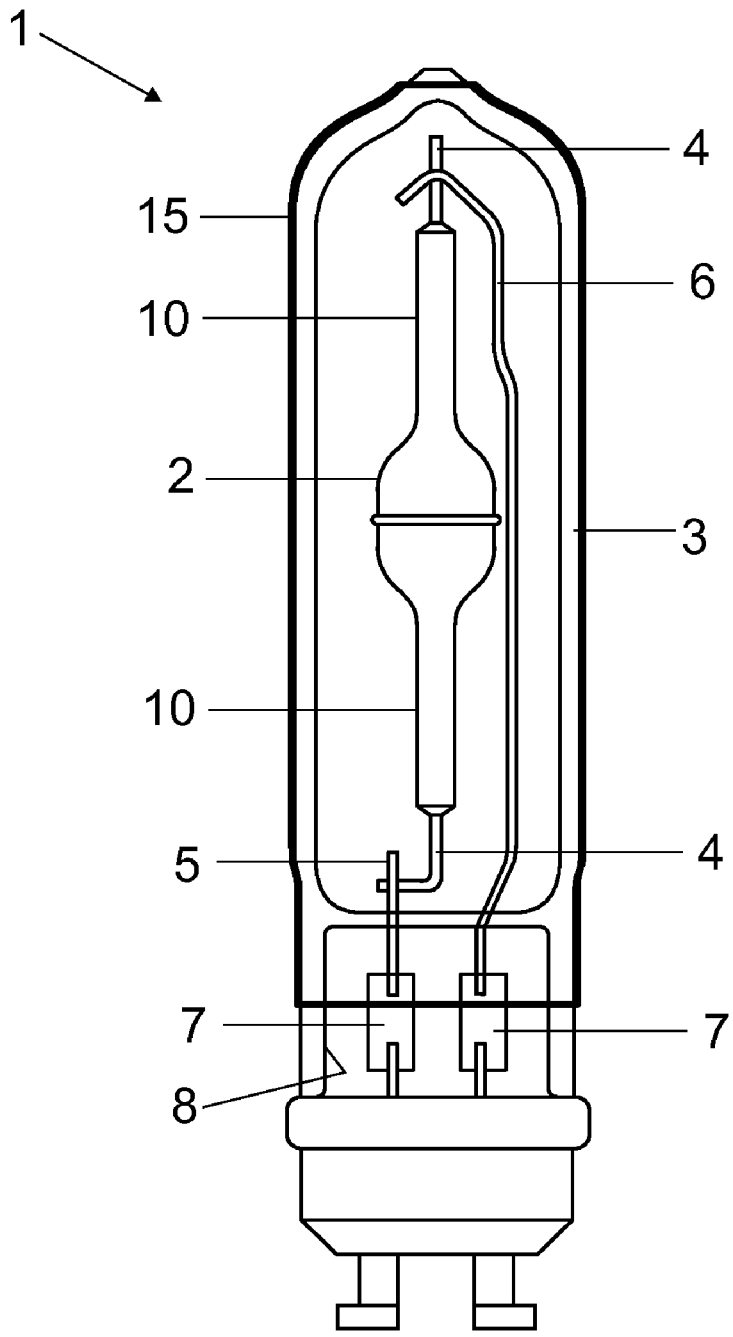
FIG. 1 shows an embodiment of a high-pressure discharge lamp.

The following detailed description refers to the accompanying drawings that show, by way of illustration, specific details and embodiments in which the invention may be practiced.

The word "exemplary" is used herein to mean "serving as an example, instance, or illustration". Any embodiment or design described herein as "exemplary" is not necessarily to be construed as preferred or advantageous over other embodiments or designs.

Various embodiments provide a high-pressure discharge lamp, which is compact and nevertheless has adequate bursting protection.

This applies e.g. to metal-halide lamps, in which case the material of the discharge vessel may be ceramic.

The rapidly developing market for lights is demanding evermore compact lamps, that is to say lamps with small diameters and lengths, which are at the same time protected against bursting and can be operated in open lights. Smaller dimensions in comparison to screw caps can be achieved by specific solutions in the cap/socket area. Various embodiments relate to lamps which are protected against bursting and which have only one outer bulb and an additional plastic sheath, in the low-wattage power range. In this case, the plastic sheath may be used for protection against bursting, for possible lamp destruction as a result of negative influences. The plastic should be suitable for high temperatures, and should be suitable for lighting purposes.

At the moment, only spray methods and dip methods are known for coating outer bulbs with temperature-stable plastics, but, however, these can be used only for relatively high-wattage lamps with large (relatively cold) outer bulbs.

Lamps with bursting protection are still provided as standard with a second outer bulb.

Various embodiments may provide: a thin flexible tube composed of plastic which is resistant to high temperatures is drawn over the lamp and is shrunk onto the bulb of the lamp by heat treatment. The ratio of the wall thickness of the shrink sleeve to the diameter of the shrink sleeve may be between 1:45 and 1:300. In various embodiments, a glass tube section may be positioned on the burner plane before the flexible tube is joined, and cools the flexible plastic tube in this area. The height of the section is one to four times the burner body diameter. The internal diameter of the glass section should be between 1.01 and 1.05 times the outer bulb diameter of the lamp. The wall thickness of the glass tube section may be between 0.5 and 1.2 mm.

Various embodiments may have one or more of the following effects:

- fundamental protection against bursting;
- cooling of the bursting protection film and additional UV protection;
- furthermore, small dimensions; and/or
- little assembly and process effort.

In various embodiments, at least as components, polycarbonate, polyester, polymethyl methacrylate or polyolefin may be suitable plastics in the form of a flexible tube. In various embodiments, the plastic may be transparent, UV-stable, high-temperature stable, and is may be composed of Teflon or PTFE.

In this case, the flexible tube is in various embodiments not simply fitted to the outer bulb, but a lower layer is introduced between the flexible tube and the outer bulb in the area where the highest temperature occurs.

FIG. 1 shows the design of a high-pressure discharge lamp 1, highly schematically. This has a discharge vessel 2 which is accommodated in an outer bulb 3. The outer leads 4 of the discharge vessel, which make contact with the electrodes in the interior, are connected to two framework wires 5 and 6. A short framework wire 5 leads to a first sheet 7 in a pinch 8 in the outer bulb 3. A long framework wire 6, frequently referred to as a bracket wire, leads to a second sheet 7 in the pinch 8. At each of its ends, the discharge vessel 2 may have a capillary 10, as known per se, as well as a filling of a gas which can be ionized, in general argon or xenon, mercury and metal halides, as likewise known per se. There are two opposite electrodes in the interior of the discharge vessel, as likewise known per se, although this is not illustrated here.

The outer bulb 3 is surrounded by a flexible tube 15 composed of Teflon, which rests closely on the major surfaces of the outer bulb, at least over an axial length which sheaths the discharge vessel.

Figure 2:
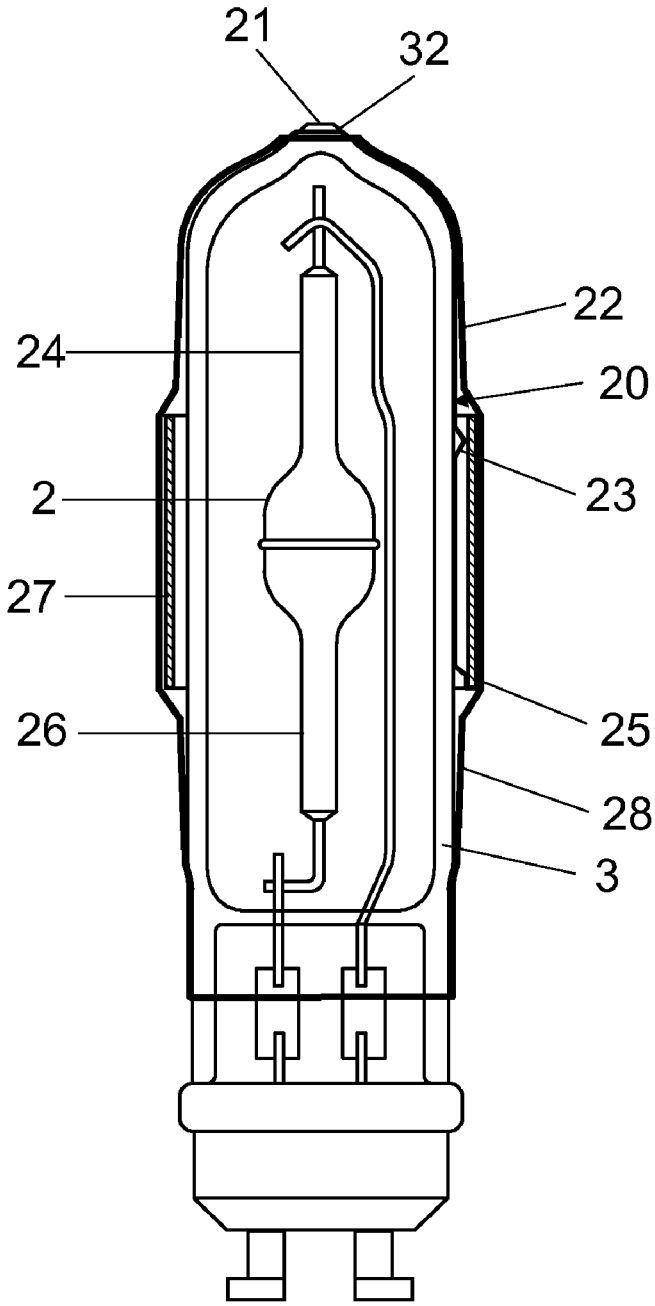
FIG. 2 shows another embodiment of a high-pressure discharge lamp.

FIG. 2 shows an embodiment which takes account of the high temperature load in an improved manner. In this case, a special holder 20 composed of metal may be fitted to the outer bulb 3. This is shaped such that it has an annular part 32 which surrounds the pump connecting stub 21 of the outer bulb. A bent part 22 may be drawn down to the level of the discharge vessel. This part may have a bead 23 as a spacer, approximately at the same level as the capillary 24 which is remote from the discharge in the discharge vessel, and a holder 25, which is bent in a U-shape, approximately at the same level as the capillary 26 which is close to the discharge. As temperature protection, a tube 27 may be fitted on the outside to the outer bulb 3 at the same level as the discharge vessel 2, e.g. composed of highly heat-resistant glass, and is oriented and fixed there by means of the holder 25 and the bead 23. A plastic sheath 28 may be fitted to the outside of the tube 27, e.g. a shrink sleeve, which is matched to the different geometry of the outer bulb 3, including the holder 20 and the tube 27.

The discharge vessel need not be composed of ceramic, and may also be manufactured from quartz glass or the like. A pump connecting stub is also not absolutely essential, but in this case makes it easier to attach the holding ring.

Figure 3:
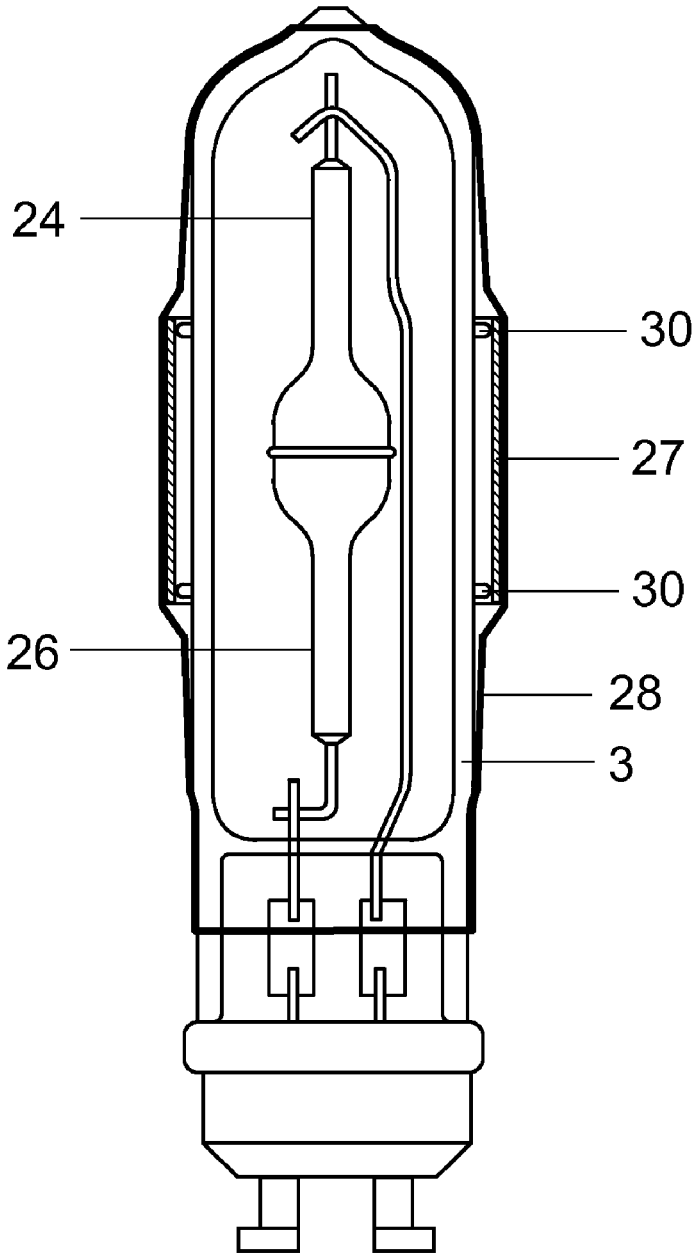
FIG. 3 shows another embodiment of a high-pressure discharge lamp.

The holding ring may also be designed differently; in principle, studs which are fitted to the outside of the outer bulb and are composed of glass or the like, are sufficient for carrying out the fundamental task of a spacer. FIG. 3 shows an embodiment such as this, in which studs 30 composed of glass are fitted over the circumference of the outer bulb 3, in two lines approximately at the same level as the two capillaries 24, 26. The tube 27 is positioned on them. The tube is actually fixed by means of the flexible tube 28, which is shrunk on. The length of the shrink sleeve should be at least 70% of the axial length of the cylindrical outer bulb.

Figure 4:
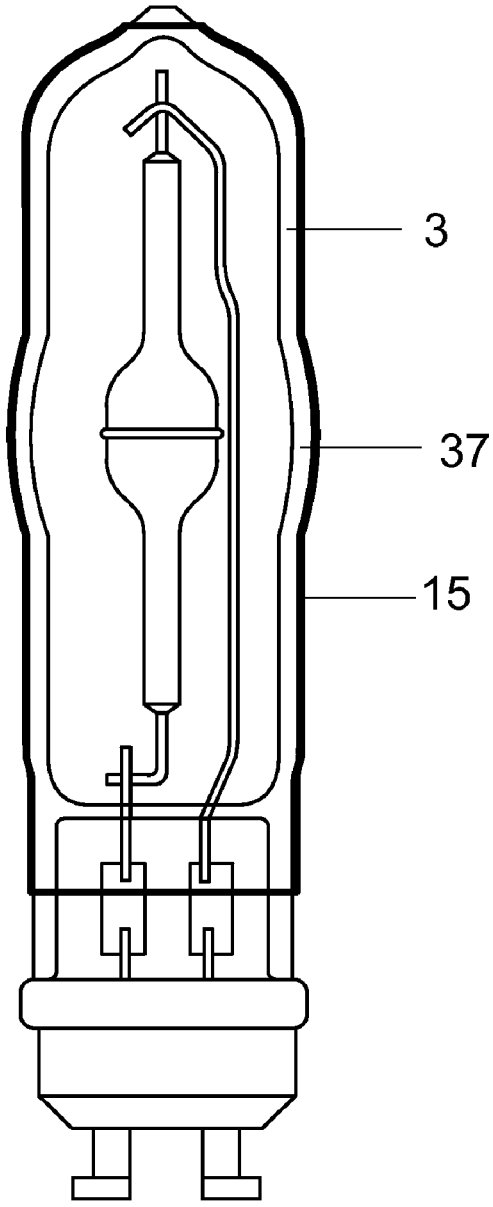
FIG. 4 shows another exemplary embodiment of a high-pressure discharge lamp.

One major advantage of the shrink sleeve is that it can also be used for outer bulbs with bulges, see FIG. 4. There, the outer bulb 3 has a central outward bulge 37, over which the shrink sleeve 15 extends.

Various embodiments may be summarized by stating that a high-pressure discharge lamp has a ceramic discharge vessel which is accommodated in an outer bulb, wherein the outer bulb is also surrounded by fragment protection, which rests closely on the outer bulb. In this case, the outer bulb may generally have a cap at one end, and the discharge vessel is equipped with two ends. In various embodiments, the fragment protection may be a shrink sleeve.

Features of various embodiments are presented below:

In various embodiments, a high-pressure discharge lamp is provided, having a discharge vessel which is accommodated in a tubular outer bulb, wherein a major part of the outer bulb is closely surrounded by a transparent sleeve composed of highly heat-resistant plastic.

In various embodiments, the discharge vessel may be manufactured from ceramic, and, for example, may have two capillaries.

In various embodiments, the sleeve may be in the form of a shrink sleeve.

In various embodiments, e.g. for temperature protection reasons, a tube may surround the outer bulb at the level of the discharge vessel, below the sleeve, wherein the material of the tube may be more heat-resistant than that of the sleeve.

In various embodiments, the tube may be manufactured from hard glass or quartz glass.

In various embodiments, the tube may be seated on the outer bulb by means of a spacer.

In various embodiments, the spacer may be formed by projections in the form of studs.

In various embodiments, the spacer may be a holding ring composed of metal, which may have a holding apparatus for the tube.

In various embodiments, the outer bulb may have an outward bulge.

While the invention has been particularly shown and described with reference to specific embodiments, it should be understood by those skilled in the art that various changes in form and detail may be made therein without departing from the spirit and scope of the invention as defined by the appended claims. The scope of the invention is thus indicated by the appended claims and all changes which come within the meaning and range of equivalency of the claims are therefore intended to be embraced.

What is claimed is:

1. A high-pressure discharge lamp, comprising:

a discharge vessel which is accommodated in a tubular outer bulb, wherein a major part of the outer bulb is closely surrounded by a transparent sleeve composed of highly heat-resistant plastic.

2. The high-pressure discharge lamp as claimed in claim 1, wherein the discharge vessel is manufactured from ceramic.

3. The high-pressure discharge lamp as claimed in claim 2, wherein the discharge vessel has two capillaries.

4. The high-pressure discharge lamp as claimed in claim 1, wherein the sleeve is in the form of a shrink sleeve.

5. A high-pressure discharge lamp, comprising:

a discharge vessel which is accommodated in a tubular outer bulb, wherein a major part of the outer bulb is closely surrounded by a transparent sleeve composed of highly heat-resistant plastic; and wherein a tube surrounds the outer bulb at the level of the discharge vessel, below the sleeve, wherein the material of the tube is more heat-resistant than that of the sleeve.

6. The high-pressure discharge lamp as claimed in claim 5, wherein the tube is manufactured from hard glass or quartz glass.

7. The high-pressure discharge lamp as claimed in claim 5, wherein the tube is seated on the outer bulb by means of a spacer.

8. The high-pressure discharge lamp as claimed in claim 5, wherein a spacer is formed by projections in the form of studs.

9. The high-pressure discharge lamp as claimed in claim 5, wherein a spacer is a holding ring composed of metal, which has a holding apparatus for the tube.

10. The high-pressure discharge lamp as claimed in claim 1, wherein the outer bulb has an outward bulge.

* * * * *